US006761002B1

(12) United States Patent
Sorkin

(10) Patent No.: US 6,761,002 B1
(45) Date of Patent: Jul. 13, 2004

(54) CONNECTOR ASSEMBLY FOR INTERMEDIATE POST-TENSION ANCHORAGE SYSTEM

(76) Inventor: Felix L. Sorkin, 13022 Trinity Dr., Stafford, TX (US) 77477

( * ) Notice: Subject to any disclaimer, the term of this patent is extended or adjusted under 35 U.S.C. 154(b) by 0 days.

(21) Appl. No.: 10/308,061

(22) Filed: Dec. 3, 2002

(51) Int. Cl.[7] ..... E04C 5/08
(52) U.S. Cl. ..... 52/223.13; 52/223.6; 403/374.1
(58) Field of Search ..... 52/223.6, 223.13; 403/368, 369, 374.1

(56) References Cited

U.S. PATENT DOCUMENTS 2,063,718 A * 12/1936 Berndt ..... 439/788
3,378,891 A * 4/1968 Metz ..... 403/371
4,718,209 A * 1/1988 Hansen et al. ..... 52/223.13
5,755,065 A * 5/1998 Sorkin ..... 52/223.13
6,098,356 A * 8/2000 Sorkin ..... 52/223.13
6,151,850 A 11/2000 Sorkin
6,176,051 B1 1/2001 Sorkin

* cited by examiner

*Primary Examiner*—Peter M. Cuomo
*Assistant Examiner*—Joseph Edell
(74) *Attorney, Agent, or Firm*—Harrison & Egbert

(57) ABSTRACT

A post-tension anchor system including a first tendon, a second tendon, a first anchor receiving the first tendon therein, a second anchor receiving the second tendon therein, a coupler extending over the first anchor and secured to the second anchor such that the first tendon extends through a hole in the coupler, and a cover extending over an exterior surface of the coupler so as to be engaged with the second anchor in liquid-tight relationship. The cover is an encapsulation formed in liquid-tight sealing relationship over an exterior surface of the coupler. The second anchor includes a barrel anchor and encapsulated anchor.

17 Claims, 3 Drawing Sheets

CONNECTOR ASSEMBLY FOR INTERMEDIATE POST-TENSION ANCHORAGE SYSTEM

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates to post-tensioning systems. More particularly, the present invention relates to post-tensioning systems having intermediate anchorages. Furthermore, the present invention relates to sealing devices for preventing liquid intrusion into the exposed sections of tendons in the post-tension system.

BACKGROUND OF THE INVENTION

For many years, the design of concrete structures imitated the typical steel design of column, girder and beam. With technological advances in structural concrete, however, its own form began to evolve. Concrete has the advantages of lower cost than steel, of not requiring fireproofing, and of its plasticity, a quality that lends itself to free flowing or boldly massive architectural concepts. On the other hand, structural concrete, though quite capable of carrying almost any compressive load, is weak in carrying significant tensile loads. It becomes necessary, therefore, to add steel bars, called reinforcements, to concrete, thus allowing the concrete to carry the compressive forces and the steel to carry the tensile forces.

Structures of reinforced concrete may be constructed with load-bearing walls, but this method does not use the full potentialities of the concrete. The skeleton frame, in which the floors and roofs rest directly on exterior and interior reinforced-concrete columns, has proven to be most economic and popular. Reinforced-concrete framing is seemingly a quite simple form of construction. First, wood or steel forms are constructed in the sizes, positions, and shapes called for by engineering and design requirements. The steel reinforcing is then placed and held in position by wires at its intersections. Devices known as chairs and spacers are used to keep the reinforcing bars apart and raised off the form work. The size and number of the steel bars depends completely upon the imposed loads and the need to transfer these loads evenly throughout the building and down to the foundation. After the reinforcing is set in place, the concrete, a mixture of water, cement, sand, and stone or aggregate, of proportions calculated to produce the required strength, is placed, care being taken to prevent voids or honeycombs.

One of the simplest designs in concrete frames is the beam-and-slab. This system follows ordinary steel design that uses concrete beams that are cast integrally with the floor slabs. The beam-and-slab system is often used in apartment buildings and other structures where the beams are not visually objectionable and can be hidden. The reinforcement is simple and the forms for casting can be utilized over and over for the same shape. The system, therefore, produces an economically viable structure. With the development of flat-slab construction, exposed beams can be eliminated. In this system, reinforcing bars are projected at right angles and in two directions from every column supporting flat slabs spanning twelve or fifteen feet in both directions.

Reinforced concrete reaches its highest potentialities when it is used in pre-stressed or post-tensioned members. Spans as great as one hundred feet can be attained in members as deep as three feet for roof loads. The basic principle is simple. In pre-stressing, reinforcing rods of high tensile strength wires are stretched to a certain determined limit and then high-strength concrete is placed around them. When the concrete has set, it holds the steel in a tight grip, preventing slippage or sagging. Post-tensioning follows the same principle, but the reinforcing tendon, usually a steel cable, is held loosely in place while the concrete is placed around it. The reinforcing tendon is then stretched by hydraulic jacks and securely anchored into place. Pre-stressing is done with individual members in the shop and post-tensioning as part of the structure on the site.

In a typical tendon tensioning anchor assembly used in such post-tensioning operations, there are provided anchors for anchoring the ends of the cables suspended therebetween. In the course of tensioning the cable in a concrete structure, a hydraulic jack or the like is releasably attached to one of the exposed ends of each cable for applying a predetermined amount of tension to the tendon, which extends through the anchor. When the desired amount of tension is applied to the cable, wedges, threaded nuts, or the like, are used to capture the cable at the anchor plate and, as the jack is removed from the tendon, to prevent its relaxation and hold it in its stressed condition.

There are many post-tension systems employing intermediate anchorages where the length of the slab is too long to tension with a single anchor. In these systems, the intermediate anchor is interposed between a live end and a dead end anchor. In the construction of such intermediate anchorage systems, the tendon extends for a desired length to the intermediate anchor. A portion of the sheathing is removed in the vicinity of the intermediate anchor. The intermediate anchor is installed onto a form board in accordance with conventional practice. The unsheathed portion of the tendon is received by a tensioning apparatus such that the tendon is stressed in the area between the dead end anchor and the intermediate anchor. After stressing the tendon, concrete is poured over the exterior of the sheathed tendon and over the dead end anchor and intermediate anchor. The remaining portion of the tendon extends from the intermediate anchor to either another intermediate anchorage or to the live end anchor. Intermediate anchorage systems are employed whenever the slab is so long that a single live anchor extending to a single dead end anchor is inadequate. For example, two intermediate anchorages would be used for slabs having a length of approximately 300 feet.

A problem that affects many of the intermediate anchorage systems is the inability to effectively prevent liquid intrusion into the unsheathed portion of the tendon. Normally, the unsheathed portion will extend outwardly, for a distance, from the intermediate anchor in the direction toward the dead end anchor. Additionally, another unsheathed portion will extend outwardly at the intermediate anchor toward the live end anchor. In normal practice with a single live anchor and without intermediate anchors, a liquid-tight tubular member is placed onto an end of the anchor so as to cover the unsheathed portion of the tendon. This is relatively easy to accomplish since the length of the tendon is minimal at the live end. However, it is a considerable burden to attempt to slide such a tubular member along the entire length of the tendon so as to form the liquid-tight seal at the intermediate anchorage. In normal practice, tape, or other corrosion protection materials, are applied to the exposed portion of the tendon adjacent the intermediate anchorage. Extensive practice with this technique has shown that it is generally ineffective for preventing liquid intrusion into the interior of the tendon or into the interior of the intermediate anchorage. As such, a great need has developed in which to protect the exposed areas of the tendon adjacent the intermediate anchorage.

A problem inherent in such continuous tendon intermediate anchorage systems is the difficulty of installation. Conventionally, in order to install the great lengths of tendon associated with such an intermediate anchorage systems, it is necessary for the worker at the construction site to thread the anchor along the length of the tendon so as to place the anchor in a desired position. Often during this "threading" of the anchor onto the tendon, nicks and damage can occur to the sheathing on the tendon. Often, components of the intermediate anchorage system are omitted or the installation is carried out in an ineffective manner because of the large amount of manual manipulation that is required for the installation of the system. Inherently, each of the intermediate anchors will be located in a joint of the concrete structure. As such, each of the anchors will be exposed to the corroding elements in this location. The liquid resistance of the intermediate anchorage system must be particularly good so as to prevent any damage to the exposed portions of the tendon.

In one form of the installation of post-tension systems, a "splice chuck" is used so as to secure the end of one tendon to the end of a next in-line tendon. Conventionally, the splice chuck will be joined to the unsheathed portion of a first tendon and joined to the unsheathed portion of a second tendon. The use of wedges, springs and other components of the splice chuck will assure that one end of the first tendon is securely joined to the opposite end of the next in-line tendon. After the splice chuck is used to join the ends of the tendons in proper relationship, the concrete can be poured over the tendons and the splice chuck. Unfortunately, because of the use of springs, wedges and other components in the splice chuck, the splice chuck is particularly susceptible of corrosion and deterioration. The weakening of any component within the splice chuck, such as the spring, can cause the integrity of the splice chuck to become compromised and, possibly, release the end of one tendon from the end of an adjoining tendon. The exposure of the splice chuck to the corroding elements is particularly important since, as stated previously, the intermediate anchorage will inherently appear at a joint in the concrete structure.

The splice chuck can solve the problems associated with the extremely long strands or tendons throughout the concrete structure. In effect, shorter lengths of tendons can be installed and joined in secure end-to-end relationship by the use of a splice chuck. The anchors can be pre-installed onto the tendon prior to delivery to the construction site. The use of the splice chuck eliminates the need for workers to "thread" the anchor, and the other components, along the extended lengths (up to five hundred feet) of the tendon. Unfortunately, the splice chucks have not been able to be used as part of an intermediate anchorage system in which encapsulated systems are required.

The present inventor is also the inventor of U.S. Pat. No. 6,151,850, issued on Nov. 28, 2000 and U.S. Pat. No. 6,176,051, issued on Jan. 23, 2001. Each of these patents describes intermediate anchorage systems utilizing splice chucks. U.S. Pat. No. 6,151,850 teaches a post-tension anchor system having a first tendon with a sheathed portion and an unsheathed portion, a second tendon having a sheathed portion and a unsheathed portion, an anchor receiving the first tendon therein so as to have unsheathed portion of the first tendon extending outwardly from one end of the anchor, and a splice chuck receiving the unsheathed portion of the first tendon at one end thereof and receiving the unsheathed portion of the second tendon at an opposite end thereof. The cover extends over the splice chuck so as to have one end extending in liquid-tight relationship with the sheathed portion of the second tendon. The cover also includes a cap member formed in an opposite end which is engaged within the cap-receiving section of the encapsulation of the anchor. The cover includes a polymeric section extending around a portion of the body of the splice chuck and the opposite end of the splice chuck, and an elastomeric portion extending around another portion of the body at the other end of the splice chuck. The elastomeric portion overlaps an end of the polymeric section in liquid-tight relationship therewith. U.S. Pat. No. 6,176,051 describes a similar type of configuration with the introduction of a cap member that includes a tubular section having an interior area and an annular section extending radially outwardly from an end of the tubular section. The annular surface contacts an end of the wedges associated with the tendon-receiving cavity.

Although these prior patent by the present inventor provide an excellent solution to the problems identified hereinbefore, there have been certain difficulties associated with the use of such splice chucks. Most importantly, it is difficult for inspectors to be absolutely assure that the tendons have been secured in their properly tensioned relationship within the splice chuck. Additionally, the arrangements of springs, cap members and other items sometimes presented a conceptually difficult arrangement for workers at the construction site to fully comprehend. Additionally, there are certain costs associated with the formation of such splice chucks which exceeded the desired costs associated with the components used for the formation of such intermediate connection.

It is an object of the present invention to provide a connector for an intermediate anchorage system which effectively prevents liquid intrusion into the post-tension anchorage system.

It is another object of the present invention to provide a connector assembly for an intermediate anchorage which is easy to install.

It is a further object of the present invention to provide a connector assembly which assures a proper seating of the ends of the post-tension tendons within the connector assembly.

It is still a further object of the present invention to provide a connector assembly which is easy to use, easy to manufacture and relatively inexpensive.

These and other objects and advantages of the present invention will become apparent from a reading of the attached specification and appended claims.

BRIEF SUMMARY OF THE INVENTION

The present invention is post-tension anchor comprising a first tendon having a sheathed portion and unsheathed portion, a second tendon having a sheathed portion and a unsheathed portion, a first anchor receiving the unsheathed portion of the first tendon therein, a second anchor receiving the unsheathed portion of the second tendon therein, a coupler extending over the first anchor and secured to the second anchor, and a cover extending over the exterior surface of the coupler. The unsheathed portion of the second tendon will extend outwardly beyond an end of the second anchor. The first tendon extends through a hole in the coupler. The cover is a polymeric encapsulation in liquid-tight relationship with the exterior surface of the coupler.

In particular, in the preferred embodiment of the present invention, the second anchor comprises a barrel anchor having a tendon-receiving cavity therein and encapsulation anchor positioned adjacent to the end of the barrel anchor. The unsheathed portion of the second tendon is secured within the tendon-receiving cavity of the barrel anchor. The encapsulation anchor has an interior passageway through which the second tendon extends. The cover is affixed in liquid-tight relationship to the encapsulation of the encapsulated anchor. The barrel anchor has threads formed on an exterior surface thereof. The coupler has threads formed on an interior surface thereof. The coupler is threadedly engaged with the barrel anchor.

In the present invention, the first anchor is also barrel anchor having a tendon-receiving cavity formed therein. The unsheathed portion of the first tendon is secured within the cavity of the barrel anchor. The tendon-receiving cavity of the first anchor is tapered so as to have a wide opening at one end thereof. The second anchor also has a tapered tendon-receiving cavity formed therein. The second tendon has an end of the unsheathed portion received within this cavity of the second anchor. The tapered tendon-receiving cavity of the second anchor has a wide opening at an end thereof adjacent the wide opening of the first anchor. The first tendon has a plurality of wedges interposed in interference-fit relationship between the unsheathed portion of the first tendon and a wall of the cavity of the first anchor. The second anchor has a plurality of wedges interposed in interference-fit relationship between the unsheathed portion of the second tendon and a wall of the cavity of the second anchor. A resilient member is interposed between the first anchor and the second anchor within the coupler so as to urge the first anchor toward an end of the coupler.

In the preferred embodiment of the present invention, the coupler is a tubular member having an open end and a closed end. The hole is formed in the closed end. The first anchor is positioned adjacent to the closed end. The second anchor has a portion extending outwardly of the open end. The cover is a polymeric encapsulation extending over the coupler. The cover has a portion extending beyond the open end of the coupler. This portion of the coupler is in liquid-tight sealing relationship with an exterior surface of the second anchor. Additionally, the cover has a tubular portion extending beyond the closed end of the coupler. This tubular portion is axially aligned with the hole at the closed end of the coupler.

In the present invention, a first sealing member is affixed to the cover and extends outwardly therefrom and around the first tendon. This first sealing member is in liquid-tight sealing relationship with the sheathed portion of the first tendon. A second sealing member is affixed to the second anchor and extends outwardly therefrom and around the second tendon. The second sealing member is in liquid-tight sealing relationship with the sheathed portion of the second tendon.

The present invention is also a method of forming an intermediate anchorage of a post-tension anchor system comprising the steps of: (1) encapsulating a coupler within a polymeric encapsulation extending in liquid-tight relationship thereover; (2) positioning a first anchor within the coupler such that the coupler has an open end and a closed end with a hole formed in the closed end; (3) forming a first anchor assembly having a first tendon affixed within the tendon-receiving cavity of the first anchor and such that the first tendon extends through the hole in the closed end of the coupler; (4) affixing a second tendon within the tendon-receiving cavity of the second anchor; and (5) securing the coupler to the second anchor such that the first and second tendons are axially aligned in end-to-end relationship. The polymeric encapsulation is in liquid-tight sealing relationship with the second anchor.

Also, in the method of the present invention, the step of affixing comprises affixing an end of the second tendon within a tendon-receiving cavity formed within the barrel anchor of the second anchor assembly. The step of securing comprises affixing a portion of the polymeric encapsulation to an exterior surface of the encapsulation of the encapsulated anchor. The step of securing further comprises threadedly securing the coupler to an exterior surface of the barrel anchor associated with the second anchor assembly. A resilient member is positioned between the first and second anchors within the couplers so as to resiliently urge the first anchor toward an end of the coupler.

DETAILED DESCRIPTION OF THE INVENTION

Figure 1:
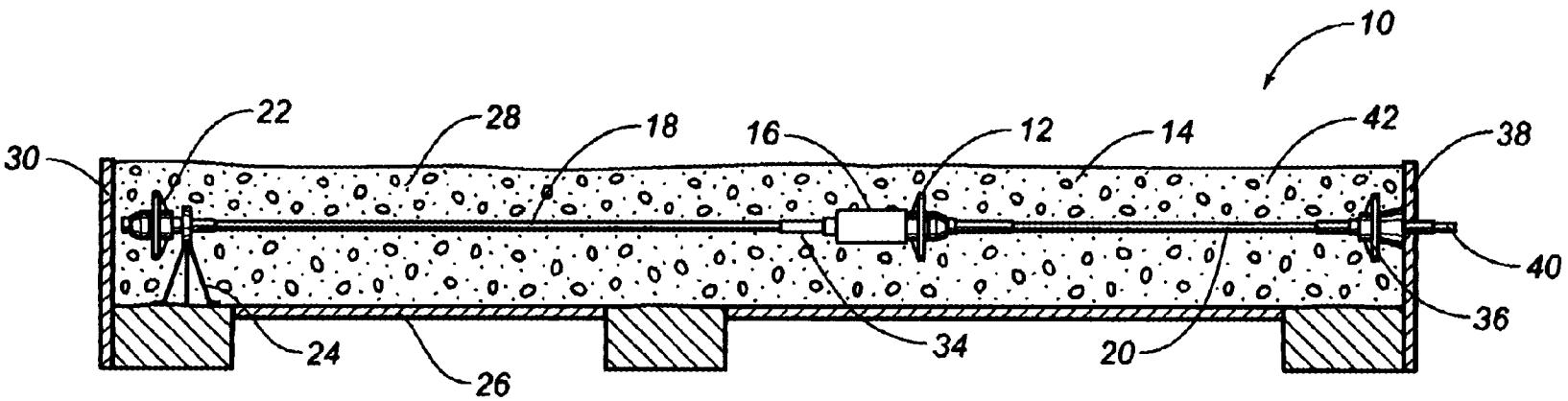
FIG. 1 is a diagrammatic illustration of the installation of the intermediate anchorage in accordance with the method of present invention.

Referring to FIG. 1, there is shown a post-tension anchor system 10 employing an intermediate anchorage 12 located within the interior of concrete structure 14. The present invention is a method installing the intermediate anchorage 12 through the use of a connector assembly 16. The post-tension system 10 illustrates the use of first tendon 18 and the second tendon 20.

In the method of the present invention, a first anchor 22 is positioned on a support 24 extending above the floor 26. One end of the first tendon 18 is received within the anchor 22 and extends outwardly therefrom. The opposite end of the tendon 18 is received within the intermediate anchorage 12. Conventionally, a form board will be placed adjacent to the intermediate anchorage 12 so as to allow for the pouring of the concrete 28 in the area between the intermediate anchorage 12 and over the end of the dead end anchor 22. Eventually, the concrete 28 will be solidified in this area. An unsheathed portion of the first tendon 18 will be affixed within the interior of the anchor 12 and is encapsulated with a polymeric material. A plastic tubular member 34 extends from the anchor 12 over the unsheathed portion of the first tendon 18. It should be noted that the unsheathed portion of the tendon 18 is installed within the intermediate anchorage 12 at the factory so that the tendon 18, along with the anchor connected to the unsheathed portion thereof, can be transported to the construction site.

Once the concrete 28 has suitably solidified, the end of the tendon can be suitably tensioned at the first anchor 22. The tensioning device must act on an unsheathed portion of the first tendon 18 extending outwardly of the anchor 22. After the tensioning has been completed, the tendon 18 will reside within the concrete 20 in a tensioned condition.

So as to join the first tendon 18 to the second tendon 20 in end-to-end relationship, the unsheathed portion of the second tendon 20 is affixed within the connector assembly 16 in the manner to be described hereinafter. The connector assembly will establish the liquid-tight seal with exterior surfaces of the anchors secured to the unsheathed end of the second tendon 20 at the intermediate anchorage 12. The second tendon 20 can then extend from the intermediate anchor 12 to a third anchor 36. The anchor 36 is secured to the form board 38. The unsheathed end 40 of the second tendon 20 extend outwardly of the form board 38 from the anchor 36. The concrete 42 is then poured into the area between the intermediate anchorage 12 and the form board 38 and allowed to solidify. Once the concrete 42 has solidified, the unsheathed end 40 of the second tendon 20 can be appropriately tensioned. As such, the present invention provides a method of forming an intermediate anchorage 20 which included separate tendons 18 and 20 arranged in end-to-end axially-aligned relationship. It should also be noted that the unsheathed end 40 of the second tendon 20 can also be joined in end-to-end relationship in the manner described hereinbefore in association with intermediate anchorage and the connector assembly 16. As such, an extended length of the post-tension system can be created by using the method of the present invention.

Figure 2:
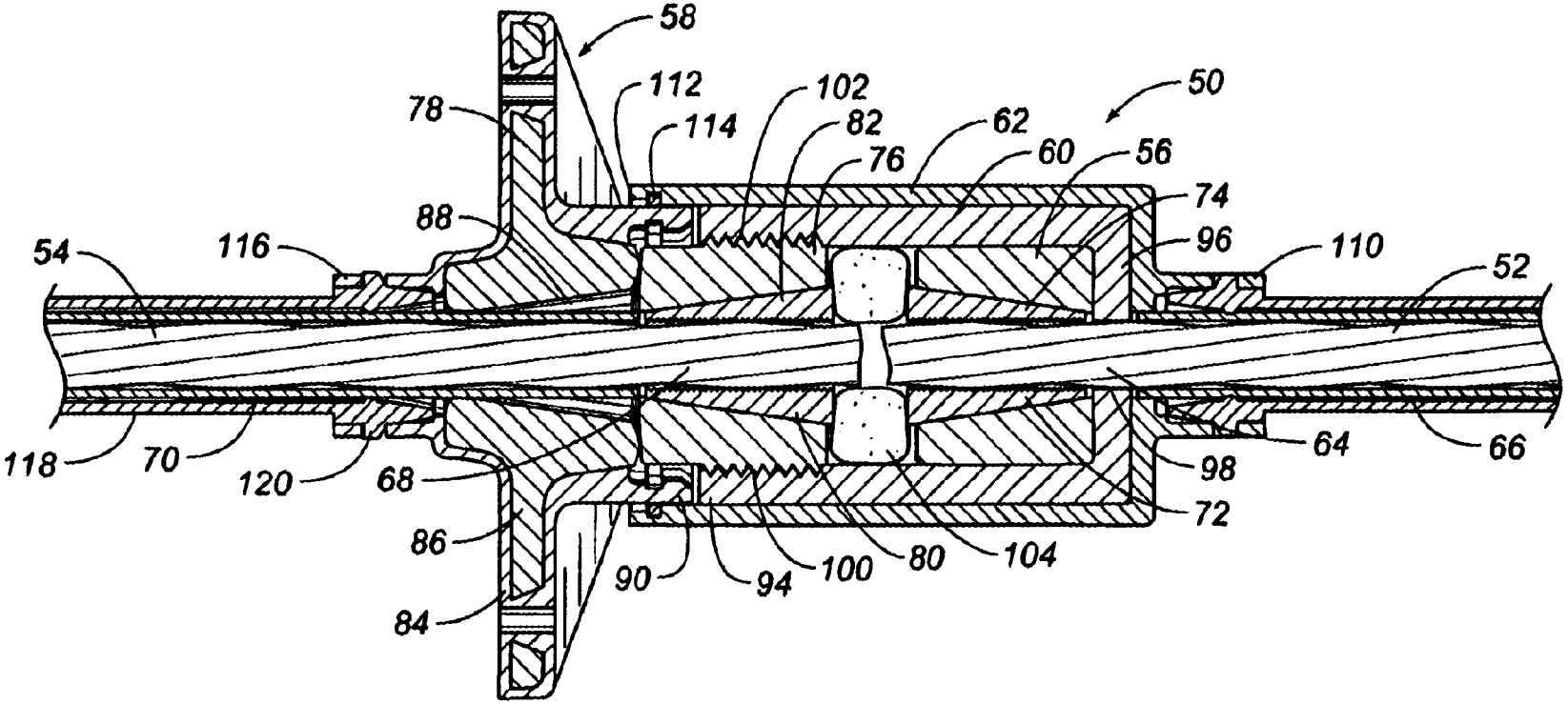
FIG. 2 is a cross-sectional view showing the intermediate anchorage assembly in accordance with the teachings of the present invention.

FIG. 2 illustrate the interior of the connector assembly 50 in accordance with the preferred embodiment of the present invention. The connector assembly 50 includes a first tendon 52, a second tendon 54, a first anchor 56, a second anchor 58, a coupler 60 and a cover 62. The first tendon 52 has an unsheathed portion 64 and a sheathed portion 66. The second tendon 54 has an unsheathed portion 68 and a sheathed portion 70. The first anchor 56 is barrel anchor that receives the unsheathed portion 64 of the first tendon 52 such that the sheathed portion 66 extends outwardly beyond one end of the first anchor 56. In particular, the first anchor 56 has a tapered tendon-receiving cavity 72 formed therein with a plurality of wedges 74 positioned therein in an interference-fit relationship between the inner wall of cavity 72 and the exterior surface of the unsheathed portion 64 of tendon 52.

The second anchor assembly 58 includes a barrel anchor 76 and an encapsulated anchor 78. The barrel anchor 76 and the encapsulated anchor 78 are arranged in end-to-end relationship. The barrel anchor 76 has a tapered tendon-receiving cavity 80 formed therein. A plurality of wedges 82 are interposed between the wall of tendon-receiving cavity 80 and the exterior surface of the unsheathed portion 68 of tendon 54. The plurality of wedges 80 will reside in an interference-fit relationship within the cavity 80. The encapsulated anchor has polymeric encapsulation 84 extending over anchor body 86. Anchor body 86 has an interior passageway 88 formed therein. The tendon 54 will extend through the interior passageway 88 of the encapsulation anchor 78. A portion 90 of the encapsulation 84 will extend outwardly beyond the end of the steel anchor body 86 and toward the barrel anchor 76.

The coupler 60 is a steel tubular member having an open end 94 and a closed end 96. A hole 98 is formed in the closed end 96. As such, the tendon 52 will have an unsheathed portion 64 extending through the hole 98 in the closed end 96 of coupler 60. Importantly, the first anchor 56 is positioned adjacent to the closed end 96 within the interior of coupler 60. The open end 94 of the coupler 60 has an interior threaded portion 100 formed therein. Similarly, the barrel anchor 76 of the second anchor assembly 58 has external threads 102 formed therein. In this manner, the threaded portion of the coupler 60 can be threadedly secured to the exterior threads 102 of the barrel anchor 76. In this arrangement, the wide end of the interior cavity 80 of the barrel anchor 76 will face the wide end of the interior cavity 72 of the first anchor 56. A resilient member 104 is interposed between the first anchor 56 and the second anchor 58 within the coupler 60. The resilient member 104 is a rubber spring interposed between one end of the first anchor 56 and the adjacent end of the second anchor 58. The resilient member 104 will exert a force upon the first anchor 56 so as to urge the first anchor 56 so as to reside adjacent to the inner wall at the closed end 96 of the coupler 60. As a result, the rubber spring 104 will take up any slack that may be created by any space between the end of the first anchor 56 and the interior surface of the closed end 96 during the tensioning of the tendon 64. Since precise calculations are required for the tensioning of tendon 52, it is important that the first anchor 56 reside in a defined position within the coupler 60 prior to the tensioning of tendon 52. The resilient member 104 will assure that the proper interior relationship between the first anchor 56 and the closed end 96 of coupler 60 is properly achieved.

The cover 62 is a polymeric encapsulation which is formed over the exterior surface of the coupler 60. The cover 62 will have a tubular portion 110 extending outwardly from one end thereof. Tubular portion 110 will be in axial alignment with the hole 98 and the closed end 96 of coupler 60 and will be also axially aligned with the tendon-receiving cavity 72 of the first anchor 56. The cover 62 will be in liquid-tight sealing relationship with the exterior surface with the coupler 60 along the entire length of the coupler 60. The cover 62 will have a portion 112 extending outwardly beyond the end of the coupler 60. An O-ring seal 114 is positioned along an inner wall of the encapsulation of cover 62 at the outwardly extending end 112. As can be seen in FIG. 2, the outwardly extending end 112 of the cover 62 is positioned over the outwardly extending portion 90 of encapsulation 84 so as to establish a liquid-tight sealing relationship therewith. The encapsulated anchor 78 is a standard form of encapsulated anchor presently sold by General Technologies, Inc. of Stafford, Tex. In normal use, the outwardly extending portion 90 of the encapsulation 84 would receive a cap thereover. However, in the embodiment of the present invention, this outwardly extending portion 90 is suitably configured so as to allow for the sealing connection between the cover 62 and the encapsulated anchor 78.

The encapsulated anchor 78 includes a tubular portion 116 extending outwardly therefrom. The tubular extension 116 is suitable for receiving a sealing member 118 therein. Sealing member 118 is a ZERO VOID™ seal, presently manufactured by General Technologies, Inc. of Stafford, Tex. The sealing member 118 is a tubular member having one end 120 in snap-fit sealing relationship with the interior surface of the tubular portion 116 of encapsulated anchor 78. The sealing member 118 will extend over the sheathed portion of the second tendon 54 and will establish a liquid-tight sealing relationship therewith. Similarly, another sealing member 122 will be affixed in a snap-fit sealing relationship within the interior surface of the tubular portion 110 of the encapsulation surrounding the coupler 60. The sealing member 122 is also a ZERO VOID™ seal as manufactured by General Technologies, Inc. of Stafford, Tex. The sealing member 122 will extend outwardly from the tubular portion 110 over the sheathed portion 66 of the first tendon 52 so as to establish a liquid-tight sealing relationship therewith.

In normal use, the first tendon 52 will be secured within the first anchor 56 at the factory in a properly secure relationship within the interior cavity 72 of anchor 56. The anchor 56 will be positioned within the coupler 60. Coupler 60 will have the cover 62 encapsulated thereover. The tendon 52 will extend through the hole 68 of the coupler 60 and outwardly therefrom through the tubular portion 110 of the encapsulation of cover 62. As a result, the opposite end of tendon 52 can be properly tensioned at its opposite end.

Subsequent to installation, the tendon 54 can be installed, along with wedges 82, within the barrel anchor 76 of the anchor assembly 58. The coupler 60 can then be threadedly secured to the outer surface of the barrel anchor 76. The encapsulated anchor 78 will reside in a proper sealing relationship at the end of the barrel anchor 76 and within the encapsulation of cover 62. This fixed relationship between the anchors 56 and 76 will assure that a tensioning of tendon 54, at its opposite end, can properly occur while maintaining the liquid-tight sealing relationship between the cover 62 and the interior of the coupler 60. A proper connection between the coupler 60 and the included anchors 56 and 76 is assured by the threaded connection between the coupler 60 and the exterior surface of the barrel anchor 76, along with the interaction of the resilient member 104. For proper inspection, it is only necessary to see that the outwardly extending end 112 of the cover 62 properly resides over the outwardly extending portion 90 of the encapsulation 84 of the encapsulated anchor 78.

Figure 3:
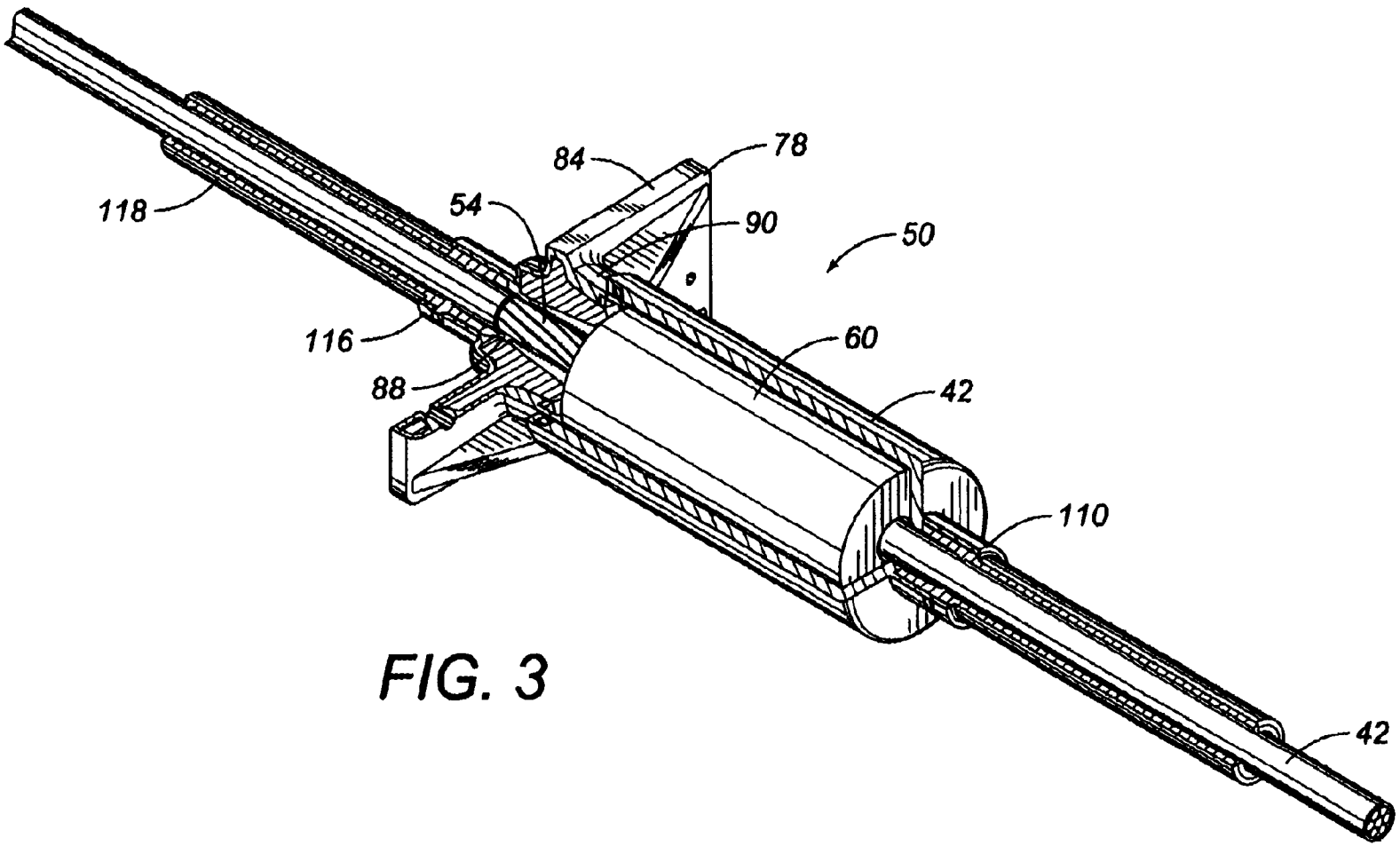
FIG. 3 is a perspective partially cross-sectional view showing the installation of the present invention as an intermediate anchorage.

FIG. 3 shows a perspective view of the intermediate anchorage 50 in accordance of the teachings of the present invention. In particular, in FIG. 3, it can be seen that the coupler 60 is positioned interior of the cover 62. The cover 62 has an outwardly extending tubular portion 110 extending therefrom and over and around the tendon 52. The cover 62 is secured in liquid-tight relationship over the outwardly extending portion 90 of the encapsulation 84 of anchor 78. FIG. 3 also shows the tendon 54 extending through the interior cavity 88 of the anchor 84 and outwardly therefrom. The sealing member 118 is illustrated as affixed within the tubular portion 116 of the encapsulation 84 of anchor 78. In this arrangement, it can be seen that the present invention allows the tendon 52 to be connected in end-to-end axial relationship with the tendon 54. Liquid intrusion into the interior area of the connector assembly 50 is effectively prevented.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. A post-tension anchor system comprising:

a first tendon having a sheathed portion and an unsheathed portion;

a second tendon having a sheathed portion and an unsheathed portion;

a first anchor receiving said unsheathed portion of said first tendon therein, said unsheathed portion of said first tendon extending outwardly beyond an end of said first anchor;

a second anchor receiving said unsheathed portion of said second tendon therein, said unsheathed portion of said second tendon extending outwardly beyond an end of said second anchor, said second anchor comprising:

a barrel anchor having a tendon-receiving cavity therein, said unsheathed portion of said second tendon being secured within said cavity of said barrel anchor; and an encapsulated anchor positioned adjacent an end of said barrel anchor, said second tendon extending through said encapsulated anchor, said encapsulated anchor being encapsulated with a polymeric material;

a coupler extending over said first anchor and secured to said second anchor, said first tendon extending through a hole of said coupler; and a cover extending over an exterior surface of said coupler.

2. The system of claim 1, said cover being affixed in liquid-tight relationship to the encapsulation of said encapsulated anchor.

3. The system of claim 1, said barrel anchor having threads formed on an exterior surface thereof, said coupler having threads formed on an interior surface thereof, said coupler being threadedly engaged with said barrel anchor.

4. The system of claim 1, said first anchor being a barrel anchor having a tendon-receiving cavity formed therein, said unsheathed portion of said first tendon being secured within said cavity of said barrel anchor.

5. The system of claim 1, said first anchor having a tapered tendon-receiving cavity formed therein, said first tendon having an end of said unsheathed portion secured within said cavity of said first anchor, said tapered tendon-receiving cavity having a wide opening at one end thereof, said second anchor having a tapered tendon-receiving cavity formed therein, said second tendon having an end of said unsheathed portion thereof received within said second anchor, said tapered tendon-receiving cavity of said second anchor having a wide opening at an end thereof adjacent said wide opening of said first anchor.

6. The system of claim 5, said first anchor having a plurality of wedges interposed in interference-fit relationship between said unsheathed portion of said first tendon and a wall of said cavity of said first tendon, said second anchor having a plurality of wedges interposed in interference-fit relationship between said unsheathed portion of second tendon and a wall of said cavity of said second anchor.

7. The system of claim 5, further comprising:

a resilient member interposed between said first anchor and second anchor within said coupler so as to urge said first anchor toward an end of said coupler.

8. A post-tension anchor system comprising:

a first tendon having a sheathed portion and an unsheathed portion;

a second tendon having a sheathed portion and an unsheathed portion;

a first anchor receiving said unsheathed portion of said first tendon therein, said unsheathed portion of said first tendon extending outwardly beyond an end of said first anchor;

a second anchor receiving said unsheathed portion of said second tendon therein, said unsheathed portion of said second tendon extending outwardly beyond an end of said second anchor;

a coupler extending over said first anchor and secured to said second anchor, said first tendon extending through a hole of coupler, said coupler being a tubular member having an open end and a closed end, said hole formed in said closed end, said first anchor slidably received in said coupler so as to abut said closed end, said second anchor extending outwardly of said open end; and a cover extending over an exterior surface of said coupler.

9. The system of claim 8, said cover being a polymeric encapsulation extending over said coupler, said cover having a portion extending beyond said open end of said coupler, said portion of said cover in liquid-tight sealing relationship with an exterior surface of said second anchor.

10. The system of claim 8, said cover having a tubular portion extending outwardly beyond said closed end of said coupler, said tubular portion being axially aligned with said hole of said closed end.

11. The system of claim 8, further comprising:

a first sealing member affixed to said cover and extending outwardly therefrom and around said first tendon, said first sealing member being in liquid-tight sealing relationship with said sheathed portion of said first tendon; and a second sealing member affixed to said second anchor and extending outwardly therefrom and around said second tendon, said second sealing member being in liquid-tight sealing relationship with said sheathed portion of said second tendon.

12. A connector for tendons of a post-tension system comprising:

a first anchor having a tendon-receiving cavity formed therein;

a second anchor having a tendon-receiving cavity formed therein;

a coupler extending over said first anchor and secured to said second anchor; and a cover extending over an exterior surface of said first and second anchors, said second anchor comprising:

a barrel anchor having said tendon-receiving cavity formed therein, said tendon-receiving cavity having a wide opening at end thereof adjacent said first anchor; and an encapsulated anchor having an interior passageway therein in axial alignment with said tendon-receiving cavity of said barrel anchor, said cover having a portion in liquid-tight sealing relationship with an exterior surface of said encapsulated anchor, said encapsulated anchor being encapsulated with a polymeric material.

13. A connector for tendons of a post-tension system comprising:

a first anchor having a tendon-receiving cavity formed therein;

a second anchor having a tendon-receiving cavity formed therein;

a coupler extending over said first anchor and secured to said second anchor;

a cover extending over an exterior surface of said first and second anchors, said coupler being a tubular member having an open end and a closed end, said closed end having a hole formed therein in axial alignment with said tendon-receiving cavity of said first anchor, said first anchor abutting against a surface of said closed end of said coupler; and an annular elastomeric member interposed between said first and second anchors, said elastomeric member urging said first anchor against the closed end of said coupler.

14. The system of claim 13, said cover being a polymeric encapsulation extending in liquid-tight relationship over said coupler, said cover having a tubular portion extending outwardly from one end thereof, said tubular portion being in axial alignment with said tendon-receiving cavity of said first anchor.

15. A method of forming an intermediate anchorage of a post-tension anchor system comprising:

encapsulating a coupler with a polymeric encapsulation extending in liquid-tight relationship thereover;

positioning a first anchor within said coupler, said coupler having an open end and a closed end, said closed end having a hole formed therein;

forming a first anchor assembly having a first tendon affixed within a tendon-receiving cavity of said first anchor, said first tendon extending through said hole in said closed end of said coupler;

affixing a second tendon within a tendon-receiving cavity of second anchor; and securing said coupler to said second anchor such that said first and second tendons are axially aligned in end-to-end relationship, said polymeric encapsulation being in liquid-tight relationship with said second anchor, said second anchor comprising a barrel anchor and encapsulated anchor arranged in end-to-end relationship, said step of affixing comprising affixing an end of said second tendon within said barrel anchor, said step of securing comprising affixing a portion of said polymeric encapsulation over an exterior surface of said encapsulated anchor.

16. The method of claim 15, said step of securing further comprising:

threadedly securing said coupler to an exterior surface of said barrel anchor.

17. A method of forming an intermediate anchorage of a post-tension anchor system comprising:

encapsulating a coupler with a polymeric encapsulation extending in liquid-tight relationship thereover;

positioning a first anchor within said coupler, said coupler having an open end and a closed end, said closed end having a hole formed therein;

forming a first anchor assembly having a first tendon affixed within a tendon-receiving cavity of said first anchor, said first tendon extending through said hole in said closed end of said coupler;

affixing a second tendon within a tendon-receiving cavity of second anchor;

securing said coupler to said second anchor such that said first and second tendons are axially aligned in end-to-end relationship, said polymeric encapsulation being in liquid-tight relationship with said second anchor; and positioning an annular elastomeric member between said first and second anchors within said coupler so as to resiliently urge said first anchor against said closed end of said coupler.

* * * * *